US011690142B2

(12) United States Patent
Jung et al.

(10) Patent No.: US 11,690,142 B2
(45) Date of Patent: Jun. 27, 2023

(54) INDUCTION HEATING DEVICE HAVING IMPROVED DETECTION ACCURACY WITH RESPECT TO MATERIAL OF OBJECT

(71) Applicant: LG Electronics Inc., Seoul (KR)

(72) Inventors: Kyung Hoon Jung, Seoul (KR); Dooyong Oh, Seoul (KR); Byeong Wook Park, Seoul (KR)

(73) Assignee: LG Electronics Inc., Seoul (KR)

( * ) Notice: Subject to any disclaimer, the term of this patent is extended or adjusted under 35 U.S.C. 154(b) by 507 days.

(21) Appl. No.: 16/934,891

(22) Filed: Jul. 21, 2020

(65) Prior Publication Data

US 2021/0084721 A1 Mar. 18, 2021

(30) Foreign Application Priority Data

Sep. 17, 2019 (KR) ..... 10-2019-0113978

(51) Int. Cl.
*H05B 6/06* (2006.01)
*H05B 6/36* (2006.01)

(52) U.S. Cl.
CPC ..... *H05B 6/06* (2013.01); *H05B 6/36* (2013.01); *H05B 2213/05* (2013.01)

(58) Field of Classification Search
CPC ..... H05B 2213/05; H05B 6/06; H05B 6/062; H05B 6/36
See application file for complete search history.

(56) References Cited

U.S. PATENT DOCUMENTS

| | | | | |
|---|---|---|---|---|
| 7,075,044 | B2 * | 7/2006 | Ryu | H05B 6/062 219/668 |
| 2009/0120928 | A1 | 5/2009 | Lee et al. | |
| 2019/0120928 | A1 | 4/2019 | O'Shea et al. | |
| 2019/0124727 | A1 * | 4/2019 | Moon | H05B 6/062 |

FOREIGN PATENT DOCUMENTS

| | | |
|---|---|---|
| EP | 2059091 | 5/2009 |
| EP | 2437573 | 4/2012 |
| EP | 2680668 | 1/2014 |
| KR | 20090048789 | 5/2009 |

OTHER PUBLICATIONS

EP Extended European Search Report in European Appln. No. 20189665.1, dated Feb. 2, 2021, 5 pages.

* cited by examiner

*Primary Examiner* — Dana Ross
*Assistant Examiner* — Joe E Mills, Jr.
(74) *Attorney, Agent, or Firm* — Fish & Richardson P.C.

(57) ABSTRACT

An induction heating device includes: a working coil, an inverter, a current transformer, a current detecting circuit, a voltage detecting circuit, an AND circuit, and a controller. The induction heating device may detect presence or absence of an object and a material of the object based on a magnitude of resonance current applied to the working coil and a phase difference between the resonance current and a voltage applied to a switching element of the inverter.

20 Claims, 17 Drawing Sheets

INDUCTION HEATING DEVICE HAVING IMPROVED DETECTION ACCURACY WITH RESPECT TO MATERIAL OF OBJECT

CROSS-REFERENCE TO RELATED APPLICATION

This application claims priority to and the benefit of Korean Patent Application No. 10-2019-0113978, filed on Sep., 17, 2019 the disclosure of which is incorporated herein by reference in its entirety.

TECHNICAL FIELD

The present disclosure relates to an induction heating device having improved detection accuracy with respect to a material of an object.

BACKGROUND

Various types of cooking utensils may be used to heat food in homes and restaurants. For example, gas ranges may use gas as fuel. In some cases, cooking devices may use electricity instead of gas to heat an object such as a vessel (or a cooking vessel) or a pot, for example.

A method of heating an object via electricity may be classified into a resistive heating method and an induction heating method. In the electrical resistive method, heat may be generated based on current flowing through a metal resistance wire or a non-metallic object, such as silicon carbide, and may be transmitted to the object through radiation or conduction, to heat the object. In the induction heating method, eddy current may be generated in the object (e.g., the cooking vessel) made of metal based on a magnetic field generated, around the coil, when a high-frequency power of a predetermined magnitude is applied to the coil to heat the object.

Induction heating devices may use an induction heating method and include a working coil disposed at multiple regions of the heating device to heat a plurality of objects (e.g., cooking vessels).

FIG. 1 shows an example of an induction heating device in related art. An object detection method of the induction heating device in related art is described below with reference to FIG. 1.

Referring to FIG. 1, the induction heating device in related art may include a rectifier 20 that rectifies alternating current (AC) power to a direct current (DC) power, an inverter 40 that switches the DC power and provides a resonance voltage, a heating coil L that receives the resonance voltage and induces an eddy current to a vessel P (i.e., an object) to heat an object, a detector 50 that detects resonance voltage provided to the heating coil L, and a controller 70 that determines presence or absence of the vessel P based on the detected resonance voltage.

That is, the induction heating device shown in FIG. 1 may determine the presence or the absence of the vessel P based on the resonance voltage provided to the heating coil L as well as determining the material of the vessel P (e.g., magnetic material or nonmagnetic material) and a floor size.

However, the induction heating device shown in FIG. 1 may only determine whether the vessel P is made of magnetic material or nonmagnetic material and may not determine a material type of the vessel P. The induction heating device may have degraded resolution of the material classification, where the resolution of the material classification provides users with optimal output suitable for the material of the vessel P.

FIG. 2 is a graph showing an example of a magnitude difference between resonance currents determined based on materials of objects. Referring to FIGS. 1 and 2, even when the resonance current having the same magnitude is provided to the heating coil L, a difference may occur in the magnitude of the resonance current detected by the heating coil L depending on the material of the object (e.g., the vessel P).

That is, when the object is disposed above the heating coil L, overall resistance may increase due to resistance of the object, and thus, the magnitude of the resonance current flowing through the heating coil L may be changed (e.g., degree of attenuation of the resonance current may be increased). That is, the self-resistance of the object depends on the material of the object, and accordingly, the magnitude of the resonance current flowing through the heating coil L also depends on the material of the object.

In particular, in the case of the object made of STS430 material (A': e.g., Le Creuset product), the magnitude of the resonance current in the state in which the object is present above the heating coil L is similar to the magnitude of the resonance current in the state in which the object is not present above the heating coil L, that is, in the case of 'no load' state. The controller 70 may incorrectly determine the object made of STS430 material to be in the 'no load' state in spite of not in the 'no load' state.

In some examples, the magnitude of the resonance current applied to the object (A) made of 'ST304' material is similar to the magnitude of the resonance current of the object made of nonmagnetic 'Al (aluminum)', and the controller 70 may incorrectly determine the object made of magnetic STS304 material as 'the non-magnetic material' in spite of the object being not made of 'the non-magnetic material'.

That is, as the materials of the induction heating vessels (e.g., the objects) diversify or a vessel comprises an unusual material, the induction heating device in related art may not provide the optimal output suitable for the corresponding material and may follow a malfunction or breakage of the induction heating device from the incorrect determination with respect to the material of the vessel.

SUMMARY

The present disclosure describes an induction heating device having improved detection accuracy with respect to a material of an object.

The present disclosure also provides an induction heating device having improved detection accuracy with respect to a presence or an absence of an object.

The objects of the present disclosure are not limited to the above-mentioned objects, and other objects and advantages of the present disclosure which are not mentioned may be understood by the following description and more clearly understood by the implementations of the present disclosure. It will also be readily apparent that the objects and advantages of the disclosure may be implemented by features defined in claims and a combination thereof.

An aspect of the present disclosure is to provide an induction heating device that may include a working coil, an inverter comprising a first switching element and a second switching element that are configured to perform a switching operation and to apply resonance current to the working coil based on the switching operation, a current transformer comprising a first coil connected to the inverter and the working coil that are configured to change a magnitude of the resonance current in the first coil, a current detecting circuit electrically connected to the current transformer, the current detecting circuit being configured to receive a first resonance current which is the resonance current having changed magnitude and output a first voltage based on the received first resonance current, a voltage detecting circuit electrically connected to the inverter, the voltage detecting circuit being configured to receive a switching voltage applied to the second switching element and to output a second voltage based on the received switching voltage, an AND circuit configured to receive the first voltage and the second voltage and to output a pulse based on the received first voltage and the received second voltage, and a controller. The controller may be configured to control the switching operation, receive the output pulse from the AND circuit, and determine a material of an object on the working coil based on a width of the received pulse.

Implementations according to this aspect may include one or more of the following features. For example, the current detecting circuit may include a first current detecting resistor electrically connected to a second coil of the current transformer, a diode electrically connected to the first current detecting resistor, a second current detecting resistor electrically connected to the diode in series, a third current detecting resistor including a first end electrically connected to the second current detecting resistor and a second end connected to a ground, and a first comparator connected to a first node between the second current detecting resistor and the third current detecting resistor, the first comparator being configured to output the first voltage.

In some examples, the current transformer may further include a second coil that a number of coil windings of the second coil is greater than a number of coil windings of the first coil and the resonance current having the magnitude less than the magnitude of the resonance current in the first coil is applied.

In some implementations, (i) the resonance current applied to the second coil may be converted into a resonance voltage having a direction opposite to the resonance current through the first current detecting resistor, (ii) the diode may be configured to remove a negative voltage from the resonance voltage converted through the first current detecting resistor, (iii) the resonance voltage from which the negative voltage is removed may be distributed to the second current detecting resistor and the third current detecting resistor, (iv) the resonance voltage distributed to the third current detecting resistor may be applied to a positive input terminal of the first comparator, and (v) the first comparator may be configured to compare a resonance voltage applied to the positive input terminal with a first reference voltage applied to a negative input terminal, and determine a value of the first voltage based on the comparison.

In some examples, the first comparator may be configured to, based on a comparison between magnitude of the resonance voltage applied to the positive input terminal and a magnitude of the first reference voltage applied to the negative input terminal, determine a state of the value of the first voltage.

In some implementations, the current detecting circuit may further include a hysteresis circuit electrically connected between the first node and an output terminal of the first comparator.

In some examples, the hysteresis circuit may include a first hysteresis resistor electrically connected between the first node and a positive input terminal of the first comparator, and a second hysteresis resistor having a first end electrically connected to the first hysteresis resistor and the positive input terminal, and a second end electrically connected to the output terminal of the first comparator.

In some examples, (i) the resonance current applied to the second coil may be converted into a resonance voltage having a direction opposite to a direction of the resonance current through the first current detecting resistor, (ii) the diode may be configured to remove a negative voltage from the resonance voltage converted through the first current detecting resistor, (iii) the resonance voltage from which the negative voltage is removed may be applied to a positive input terminal of the first comparator through a voltage distribution process by the second current detecting resistor, the third current detecting resistor, the first hysteresis resistor, and the second hysteresis resistor, and (iv) the first comparator may be configured to calculate a plus threshold reference voltage and a negative threshold reference voltage based on a first reference voltage applied to a negative input terminal, compare the resonance voltage applied to the positive input terminal through the voltage distribution process with the plus threshold reference voltage or the minus threshold reference voltage, and determine a value of the first voltage based on the comparison.

In some implementations, the first comparator may be configured to, based on a comparison between a magnitude of the resonance voltage applied to the positive input terminal and a magnitude of the plus threshold reference voltage, determine a state of the value of the first voltage.

In some examples, the voltage detecting circuit may include (i) a first voltage detecting resistor electrically connected to the second switching element, (ii) a second voltage detecting resistor having a first end electrically connected to the first voltage detecting resistor and a second end electrically connected to a ground, and (iii) a second comparator connected to a second node between the first voltage detecting resistor and the second voltage detecting resistor, the second comparator being configured to output the second voltage.

In some implementations, (i) the switching voltage may be distributed to the first voltage detecting resistor and the second voltage detecting resistor, (ii) the switching voltage distributed to the second voltage detecting resistor may be applied to a positive input terminal of the second comparator, and (iii) the second comparator may be configured to compare the switching voltage applied to the positive input terminal with a second reference voltage applied to a negative input terminal, and determine a value of the second voltage based on the comparison.

In some examples, the second comparator may be configured to, based on a comparison between a magnitude of the switching voltage applied to the positive input terminal and a magnitude of the second reference voltage applied to the negative input terminal, determine a state of the value of the second voltage.

In some implementations, the AND circuit may include (i) a first pulse generation resistor electrically connected to an output terminal of the current detecting circuit, (ii) a second pulse generation resistor electrically connected to an output terminal of the voltage detecting circuit, (iii) a third pulse generation resistor electrically connected the second pulse generation resistor and a ground, and (iv) a third comparator electrically connected to a fourth node disposed between a third node and the first pulse generation resistor, the third node disposed between the third pulse generation resistor and the second pulse generation resistor, and the third comparator being configured to output the pulse.

In some examples, (i) the first voltage output from the current detecting circuit may be applied to the fourth node through a first voltage distribution process by the first pulse generation resistor, the second pulse generation resistor, and the third pulse generation resistor, (ii) the second voltage output from the voltage detecting circuit may be applied to the fourth node through a second voltage distribution process by the first pulse generation resistor, the second pulse generation resistor, and the third pulse generation resistor, (iii) the voltage applied to the fourth node through the first voltage distribution process and the voltage applied to the fourth node through the second voltage distribution process may be combined and applied to a positive input terminal of the third comparator, and (iv) the third comparator may be configured to compare the voltage applied to the positive input terminal with a third reference voltage applied to a negative input terminal, and generate the pulse based on the comparison.

In some implementations, the third comparator may be configured to generate the pulse in a high state or a low state, based on a comparison between a magnitude of the voltage applied to the positive input terminal and a magnitude of the third reference voltage applied to the negative input terminal.

In some examples, a width of the output pulse from the AND circuit may represent a phase difference between the resonance current applied to the working coil and the switching voltage applied to the second switching element.

In some implementations, the controller is connected to a second coil included in the current transformer or to the current detecting circuit. The controller may be configured to detect the magnitude of the first resonance current in the second coil or the current detecting circuit, calculate the magnitude of the resonance current applied to the working coil based on the detected magnitude of the first resonance current, and provide an improved accuracy in determining the material of the object based on the calculated magnitude of resonance current.

In some examples, the controller may be configured to determine, based on a presence of the object on the working coil, the material of the object or that the object is in a no-load state without the determination of the material of the object.

In some implementations, the AND circuit may be configured to output the pulse in a high state or low state based on a state of the first voltage and a state of the second voltage.

In some examples, the induction heating device may further include a resonance capacitor connected to the working coil and a plurality of snubber capacitors electrically connected to the inverter. The plurality of snubber capacitors may include a first snubber capacitor electrically connected to the first switching element and a second snubber capacitor electrically connected to the second switching element.

In some examples, the plurality of snubber capacitors may be configured to control and reduce inrush current or transient voltage generated by the first switching element and the second switching element.

In some implementations, the induction heating device may improve the detection accuracy with respect to the presence or the absence of the object and the detection accuracy with respect to the material of the object.

In some implementations, the induction heating device may provide a user with an optimum output for each material of the object and may also minimize a possibility of malfunction or breakage of the induction heating device from the incorrect determination with respect to the material of the object. Further, user satisfaction may be improved by providing users with the optimal output for each material of the object and improved reliability of the induction heating device.

In addition to the effects described above, the specific effects of the present disclosure are described together while describing matters to implement the disclosure.

DETAILED DESCRIPTION OF EXEMPLARY IMPLEMENTATIONS

Figure 1:
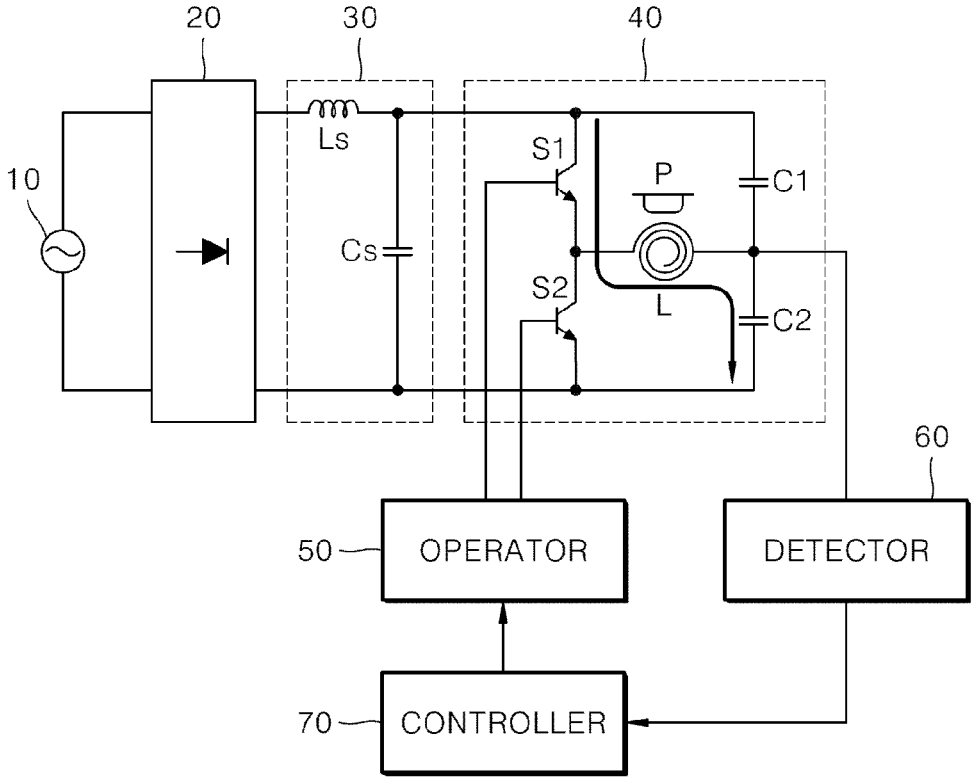
FIG. 1 Related Art
FIG. 1 shows an example of an induction heating device in related art.
Figure 2:
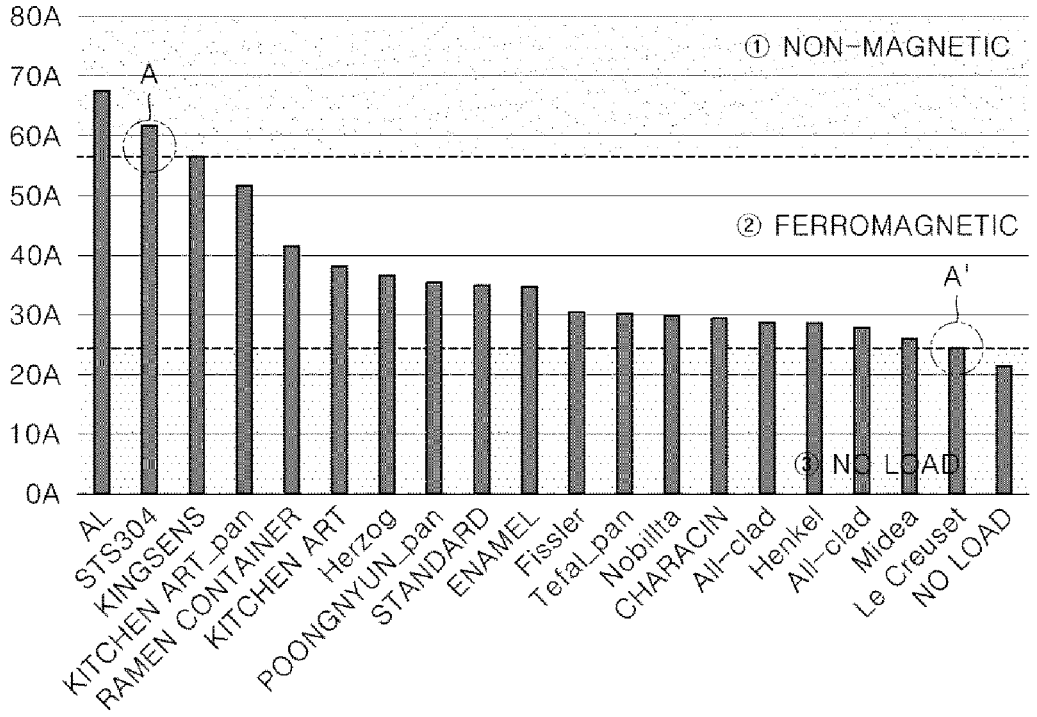
FIG. 2 Related Art
FIG. 2 is a graph showing an example of a magnitude difference between resonance currents determined based on materials of objects.

One or more examples of the present disclosure will be described in detail with reference to the accompanying drawings. The same reference numeral is used to indicate the same or similar component in the figures.

Hereinafter, when any component is arranged at "an upper portion (or a lower portion)" of the component or "on (or under") of the component, any component may be arranged in contact with an upper surface (or a lower surface) of the component, and another component may be interposed between the component and any component arranged on (or under) the component.

An induction heating device is described below with reference to FIGS. 3 to 13.

Figure 3:
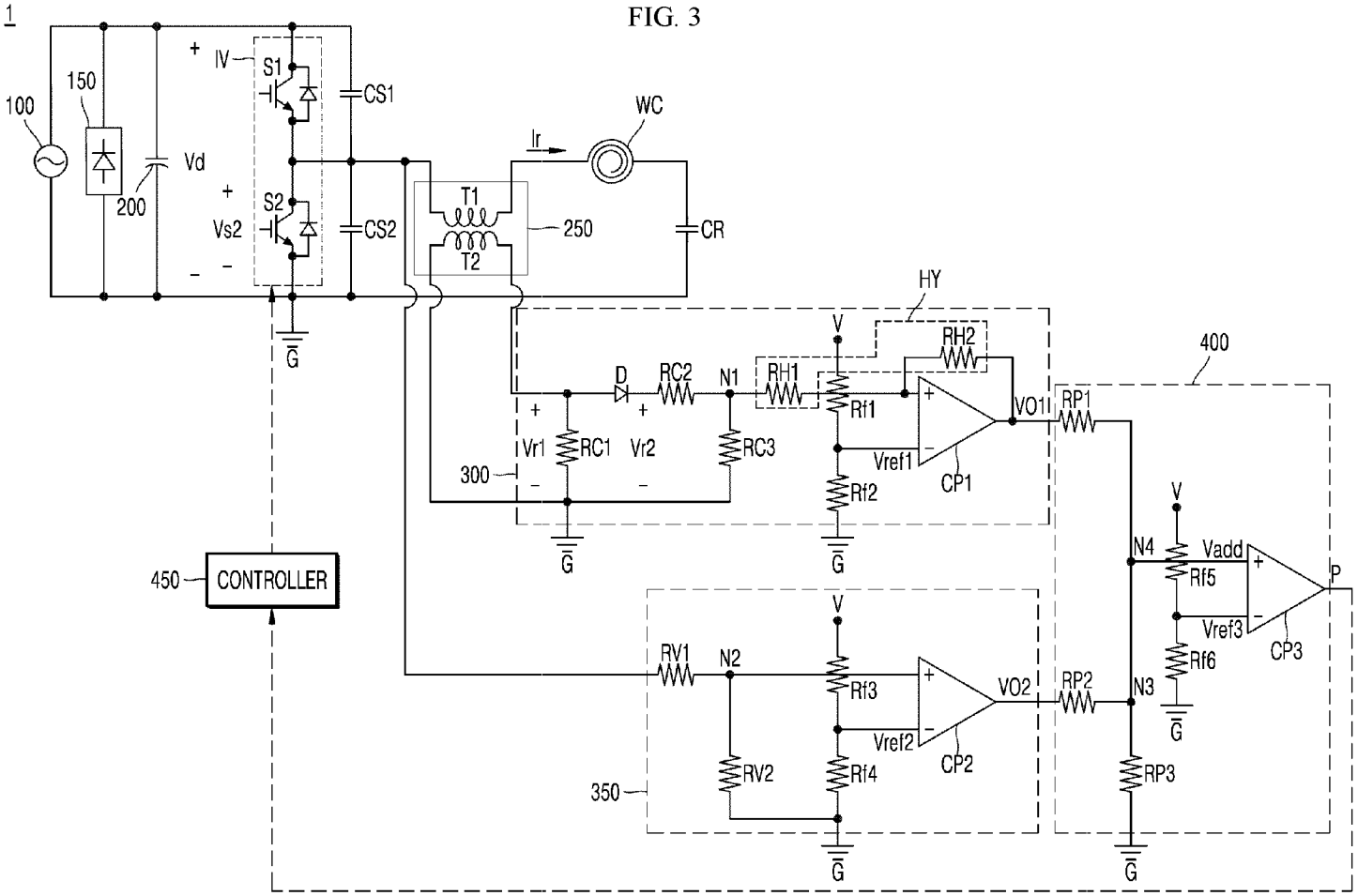
FIG. 3 is a circuit diagram showing an example of an induction heating device.
Figure 4:
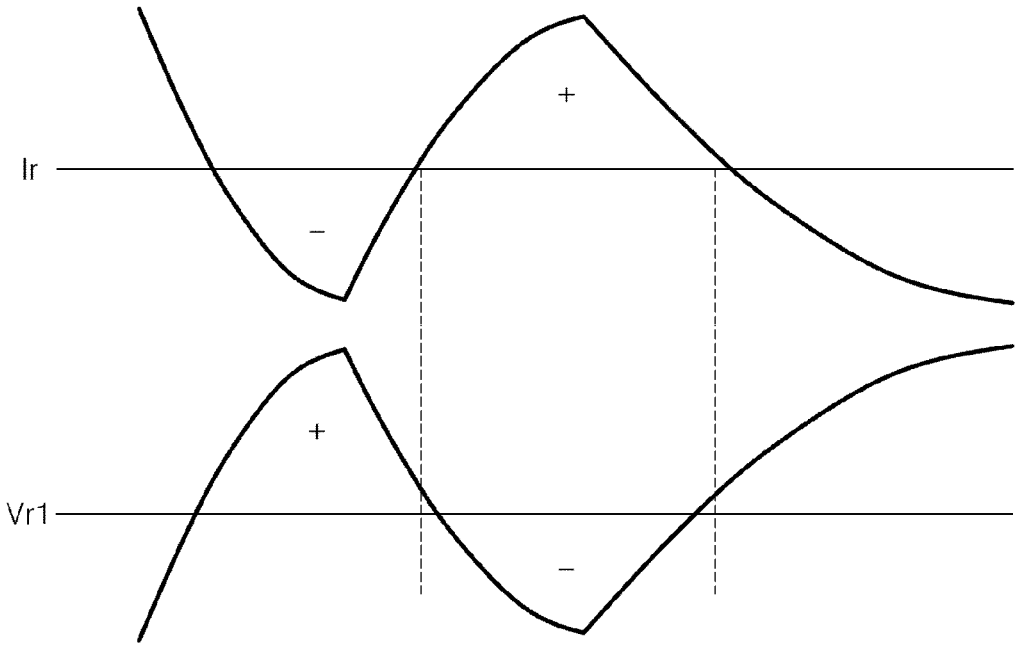
FIG. 4 shows an example voltage applied to a first current detecting resistor in FIG. 3.
Figure 5A:
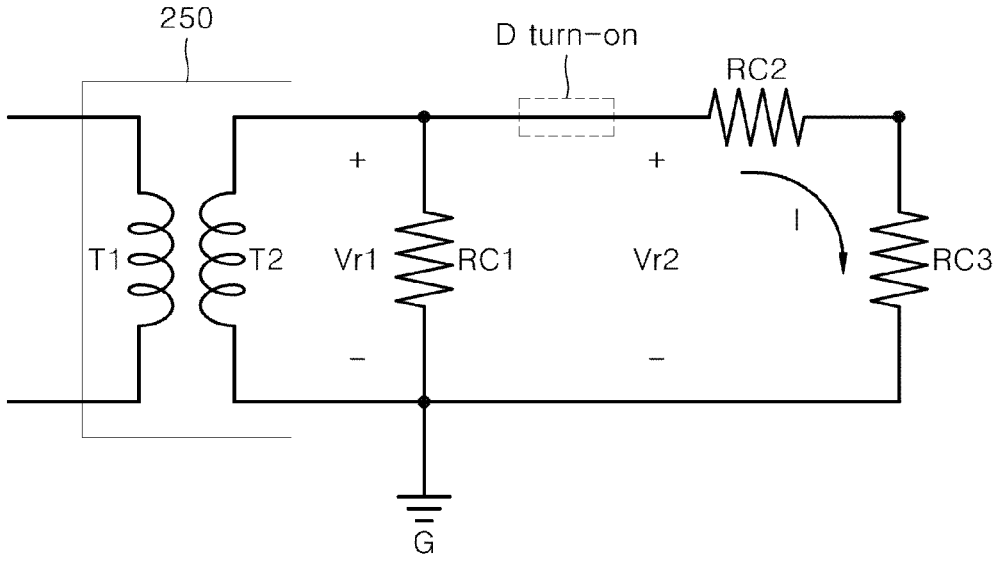
FIGS. 5A, 5B, and 6 respectively show exemplary operations of a diode shown in FIG. 3.
Figure 5B:
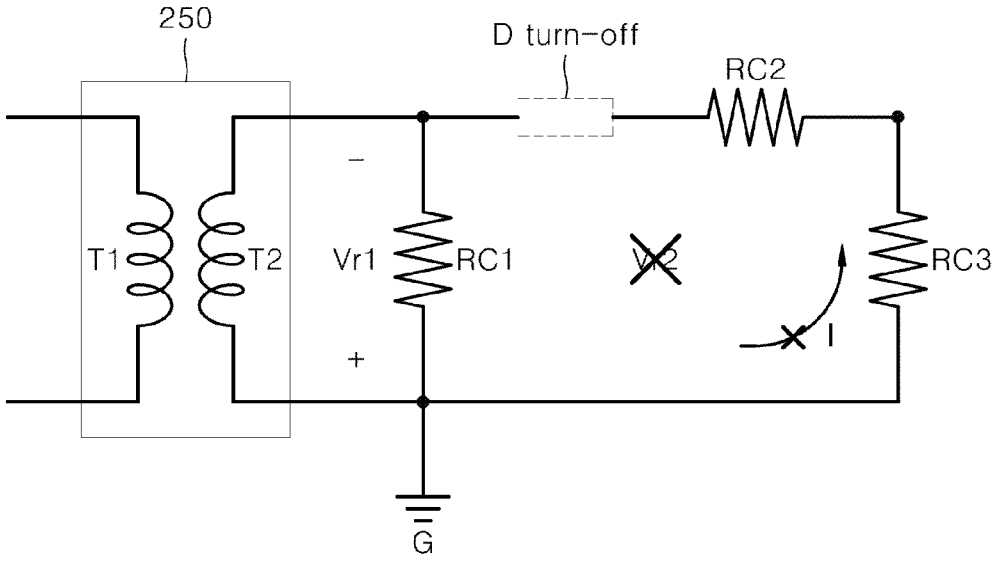
Figure 6:
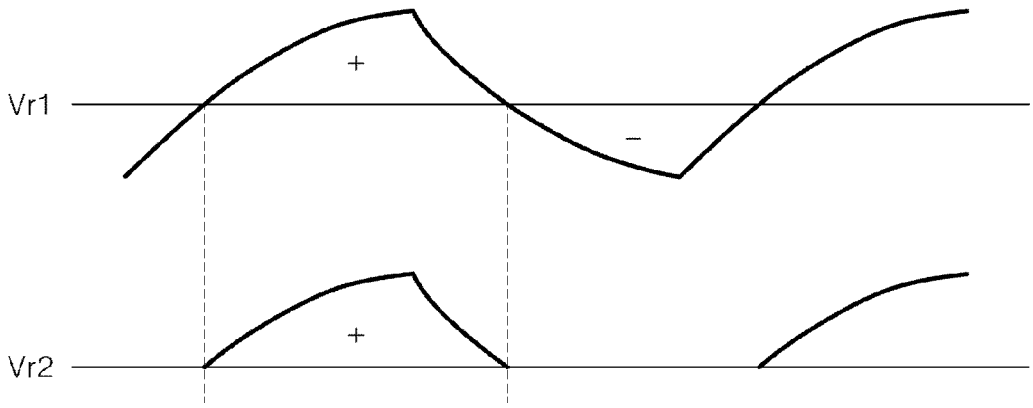
Figure 7:
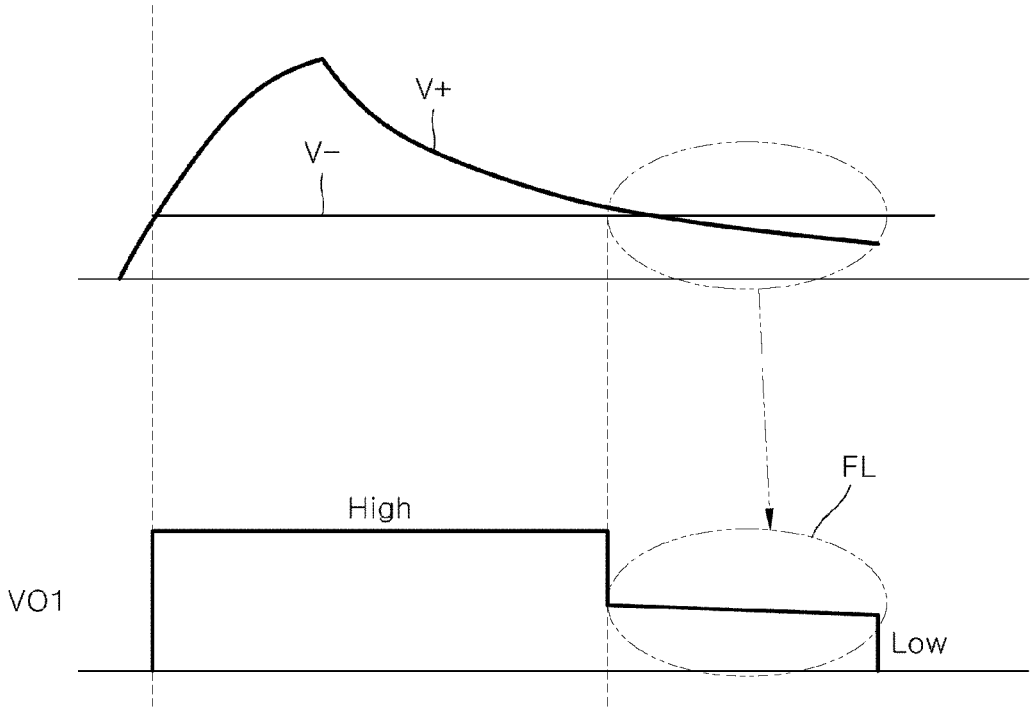
FIG. 7 shows an example of a hysteresis circuit shown in FIG. 3 that is not used for a first comparator.
Figure 8:
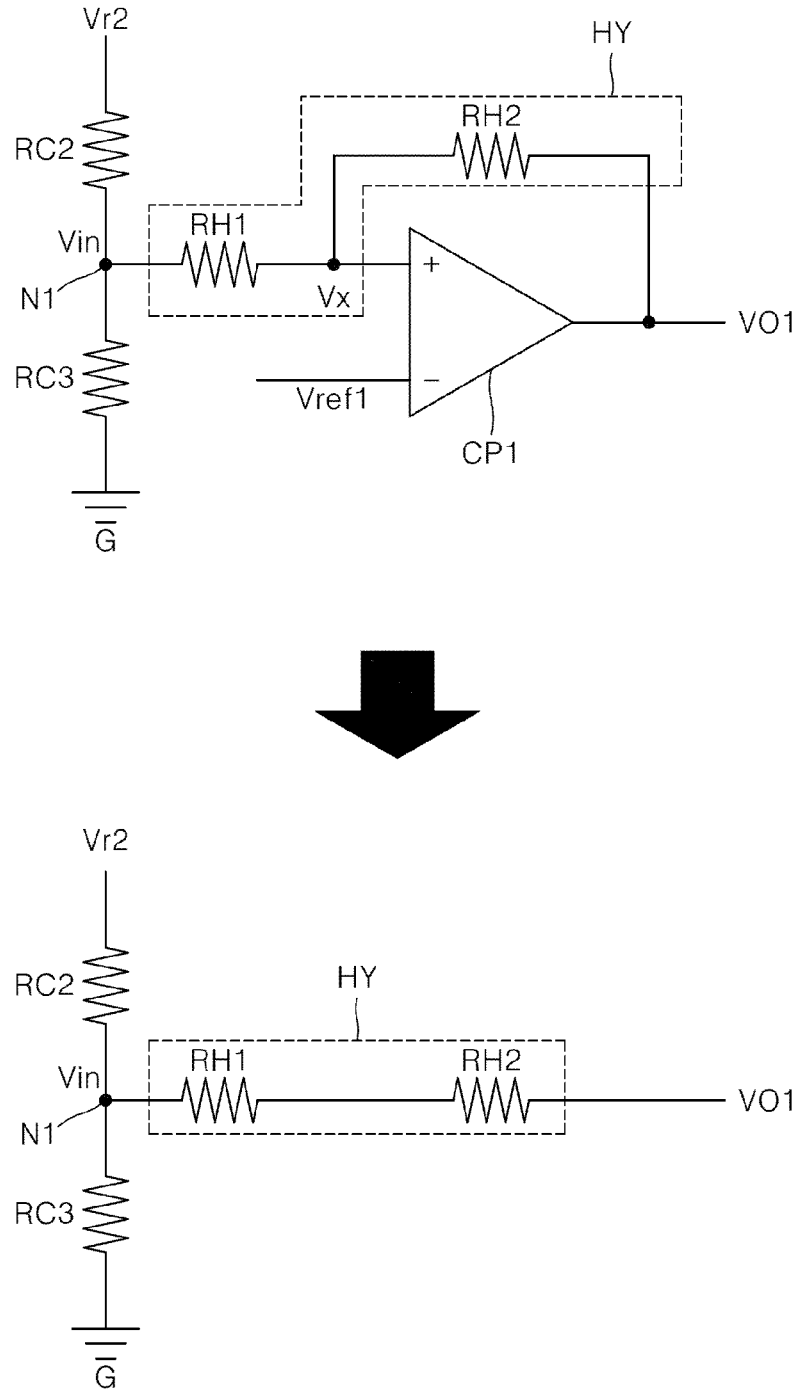
FIG. 8 shows an example of a hysteresis circuit shown in FIG. 3.
Figure 9:
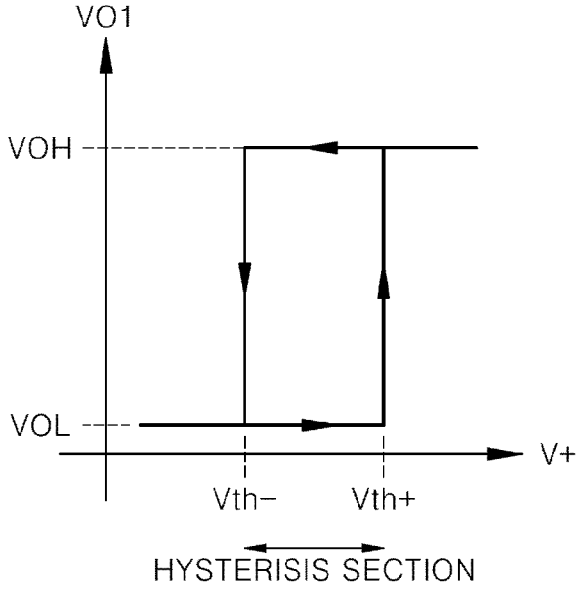
FIGS. 9 and 10 respectively show examples of input and output of a first comparator shown in FIG. 3.
Figure 10:
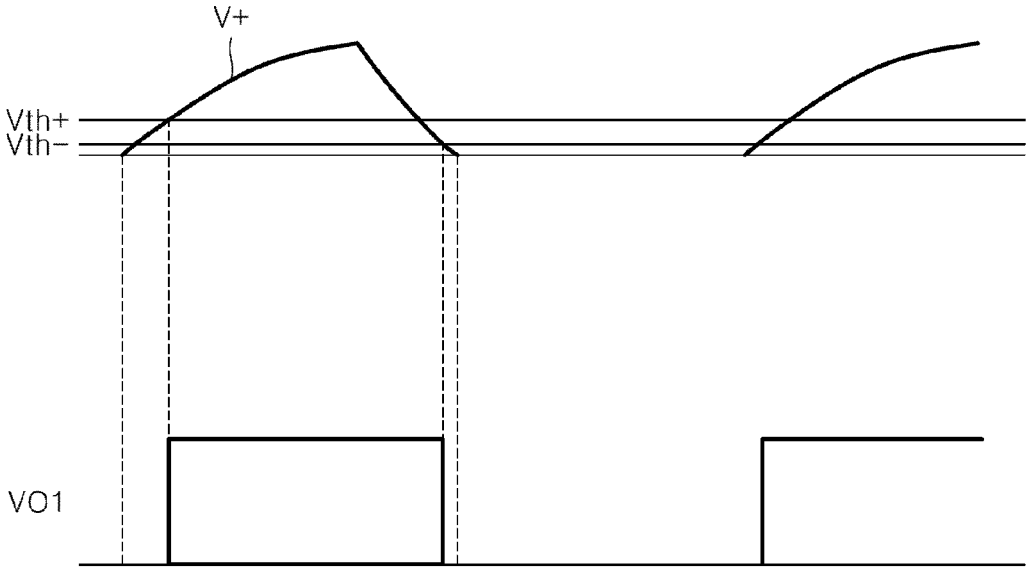
Figure 11:
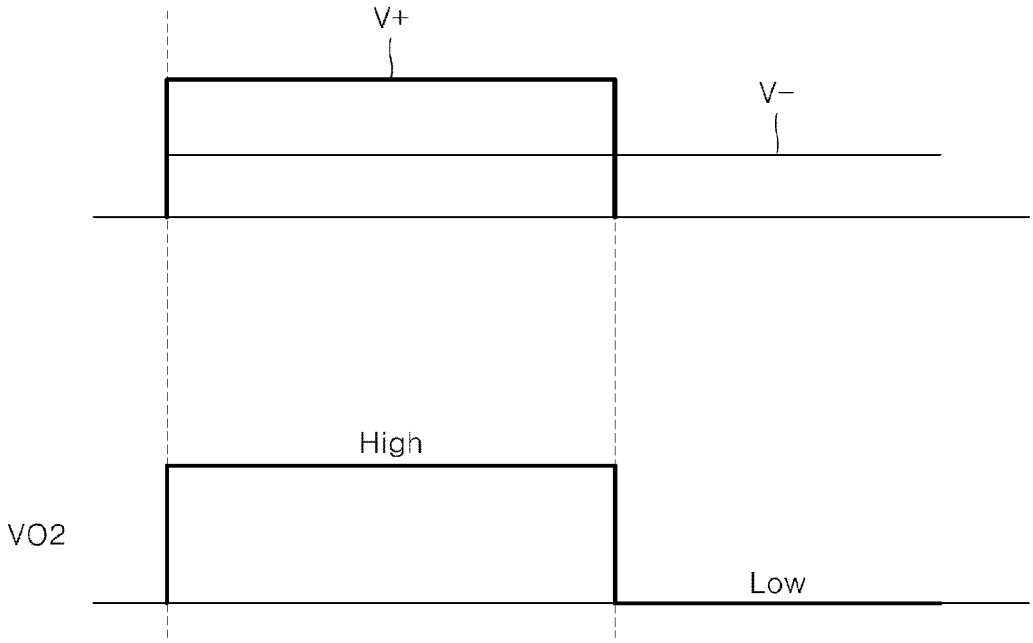
FIG. 11 shows an example of a second voltage output from a voltage detecting circuit shown in FIG. 3.

FIG. 3 is a circuit diagram showing an example of the induction heating device. FIG. 4 shows an example voltage applied to a first current detecting resistor shown in FIG. 3. FIGS. 5A, 5B, and 6 respectively show exemplary operations of a diode shown in FIG. 3. FIG. 7 shows an example of a hysteresis circuit shown in FIG. 3 that is not used for the first comparator. FIG. 8 shows an example of the hysteresis circuit shown in FIG. 3. FIGS. 9 and 10 respectively show examples of input and output of the first comparator shown in FIG. 3. FIG. 11 shows an example of a second voltage output from the voltage detecting circuit shown in FIG. 3.

Figure 12:
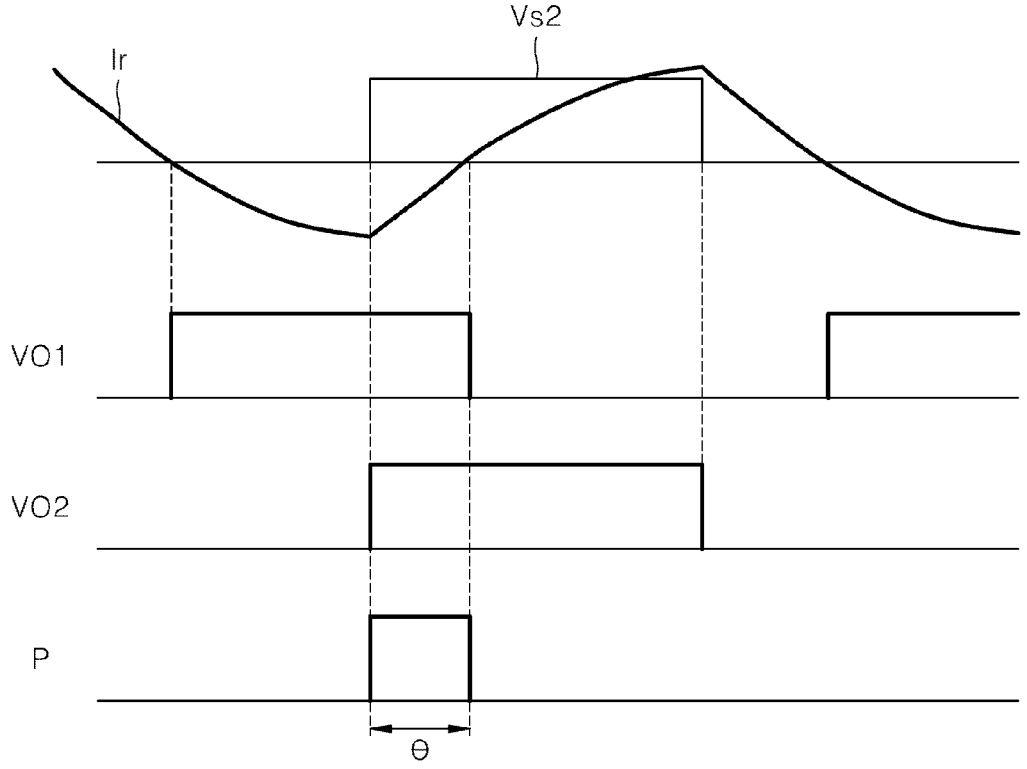
FIG. 12 shows an example of an object's material detection mechanism of an induction heating device in FIG. 3.
Figure 13:
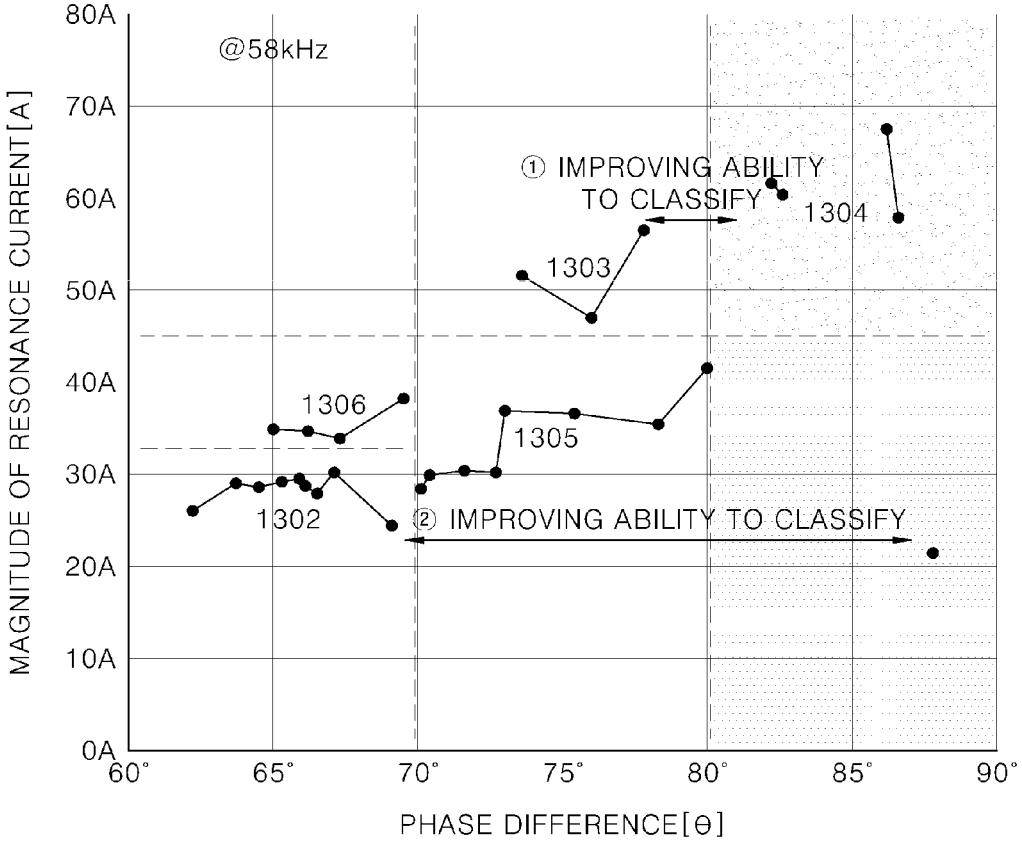
FIG. 13 is a graph showing examples of a phase difference and a magnitude of resonance current determined based on materials of objects.

FIG. 12 shows an example of an object's material detection mechanism of the induction heating device in FIG. 3. FIG. 13 shows a graph showing examples of a phase difference and a magnitude of resonance current based on materials of objects.

In some implementations, referring to FIGS. 3 to 13, the induction heating device 1 may include a power supply 100, a rectifier 150, a DC link capacitor 200, an inverter IV, a plurality of snubber capacitors CS1 and CS2, a working coil WC, a resonance capacitor CR, a current transformer 250, a current detecting circuit 300, a voltage detecting circuit 350, an AND circuit 400, and a controller 450.

The power supply 100 may output an alternating current (AC).

In some examples, the power supply 100 may output the AC and provide the rectifier 150 with the AC. For example, the power supply 100 may be a commercial power supply.

The rectifier 150 may convert the AC current supplied by the power supply 100 into a DC current and may supply the DC current to the inverter IV.

In some examples, the rectifier 150 may rectify and convert, into the DC, the AC supplied from the power supply 100, and may provide the DC link capacitor 200 with the converted DC.

The DC link capacitor 200 may reduce ripple or variation of the DC provided by the rectifier 150 to provide the inverter IV with the ripple of the DC.

In some examples, the DC link capacitor 200 may reduce the ripple of the DC provided by the rectifier 150 and may provide the inverter IV with the DC having the reduced ripple.

In some examples, the DC link capacitor 200 may include, for example, a smoothing capacitor.

The DC rectified by the rectifier 150 and the DC link capacitor 200 may be supplied to the inverter IV.

In some examples, DC voltage Vd is applied to the DC link capacitor 200 based on the DC provided by the rectifier 150, and the ripple of the DC voltage Vd is reduced by the DC link capacitor 200 to supply the DC voltage Vd having the reduced ripple to the inverter IV.

The inverter IV may be connected to a resonance circuit (e.g., a circuit region including the working coil WC and the resonance capacitor CR) and may apply resonance current to the working coil WC through the switching operation.

In some examples, the inverter IV may include, for example, a half-bridge inverter IV, and the switching operation of the inverter IV may be controlled by the controller 450 described below. For example, the inverter IV may perform switching operation based on a switching signal (i.e., a control signal and also referred to as "a gate signal") received from the controller 450. In some cases, a half-bridge type inverter may include two switching elements and two capacitors, while a full-bridge type inverter may include four switching elements.

In some examples, the inverter IV may include a first switching element S1 and a second switching element S2 that perform the switching operation, and the two switching elements S1 and S2 may be turned on and turned off based on the switching signal received from the controller 450. In some examples, the switching elements S1 and S2 may include an electric circuit, a transistor, metal oxide semiconductor field effect transistor (MOSFET), insulated-gate bipolar transistor (IGBT), a diode, or the like.

In some examples, high-frequency AC (e.g., the resonance current) may be generated by the switching operations of the two switching elements S1 and S2, and the generated high-frequency AC may be applied to the working coil WC.

Each of the plurality of snubber capacitors CS1 and CS2 and the DC link capacitor 200 may be electrically connected to the inverter IV.

In some examples, the inverter IV may be connected to the DC link capacitor 200 electrically in parallel and the first switching element S1 may be electrically connected to the first snubber capacitor CS1, and the second switching element S2 may be connected to the second snubber capacitor CS2.

The plurality of snubber capacitors CS1 and CS2 may be electrically connected to the inverter IV.

In some examples, the plurality of snubber capacitors CS1 and CS2 may include a first snubber capacitor CS1 electrically connected to the first switching element S1 and a second snubber capacitor CS2 electrically connected to the second switching element S2.

In some examples, the plurality of snubber capacitors CS1 and CS2 may control and reduce inrush current or transient voltage generated by the switching elements S1 and S2 corresponding to the plurality of snubber capacitors CS1 and CS2, and in some cases, the plurality of snubber capacitors CS1 and CS2 may remove electromagnetic wave noise.

The working coil WC may receive the resonance current from the inverter IV.

In some examples, the working coil WC has a first end of the working coil WC electrically connected to a first stage T1 of the current transformer 250 and a second end of the working coil WC electrically connected to the resonance capacitor CR.

In some examples, an eddy current may be generated between the working coil WC and the object (e.g., a cooking vessel) based on the high-frequency AC applied from the inverter IV to the working coil WC to thereby heat the object.

The resonance capacitor CR may be electrically connected to the working coil WC.

In some examples, the resonance capacitor CR may be connected to the working coil WC electrically in series and may form a resonance circuit with the working coil WC. For example, a first end of the resonance capacitor CR may be electrically connected to the working coil WC and a second end of the resonance capacitor CR may be electrically connected to a ground G.

When voltage is applied to the resonance capacitor CR by the switching operation of the inverter IV, the resonance capacitor CR resonates. In some cases where the resonance capacitor CR resonates, a magnitude of current flowing through the working coil WC electrically connected to the resonance capacitor CR is increased.

The eddy current is induced in the object disposed above the working coil WC electrically connected to the resonance capacitor CR through this process.

The current transformer 250 may include a first stage T1 electrically connected between the inverter IV and the working coil WC, and a resonance current Ir applied to the working coil WC flows through the first stage T1. The current transformer 250 may change the magnitude of the resonance current Ir flowing through the first stage T1 and may provide the current detecting circuit 300 with the resonance current having the changed magnitude. The first stage T1 may include a first coil.

In some examples, the magnitude information related to the resonance current Ir applied to the working coil WC is used in order for the induction heating device 1 to determine the presence or the absence of the object and the material of the object, and the magnitude of the resonance current Ir may be desired to be reduced to a specific magnitude or less (e.g., a magnitude of the resonance current Ir measured by the controller 450) in order for the controller 450 to use magnitude information related to the resonance current Ir. The current transformer 250 reduces the magnitude of the resonance current Ir to a specific magnitude or less.

The current transformer 250 may also include a first stage T1 in which a coil is wound around the first stage T1 and a second stage T2 in which a coil is wound around the second stage T2. The first stage T1 is electrically connected between the inverter IV and the working coil WC and the second stage T2 may be electrically connected to the current detecting circuit 300 (e.g., the first current detecting resistor RC1). In some examples, the current transformer 250 may change the magnitude of the current flowing through the first stage T1 and may apply the current having the changed magnitude to the second stage T2.

The resonance current Ir applied to the working coil WC from the inverter IV flows through the first stage T1 and the resonance current having the less magnitude than the magnitude of the resonance current Ir flowing through the first stage T1 may be applied to the second stage T2. The second stage T2 may include a second coil.

In some examples, a number of coil windings of each of the first stage T1 and the second stage T2 is inversely proportional to the magnitude of the current flowing through each of the first stage T1 and the second stage T2, and a number of coil windings (i.e., a number of windings around the coil) of the second stage T2 is greater than a number of coil windings of the first stage T1, and thus, the magnitude of the resonance current applied to the second stage T2 may be less than the magnitude of the resonance current flowing through the first stage T1.

The current detecting circuit 300 may be electrically connected to the current transformer 250 to receive the resonance current the magnitude of which is changed, and may output the first voltage VO1 based on the received resonance current. In some examples, the current detecting circuit 300 may output the first voltage VO1 to provide the AND circuit 400 with the first voltage VO1.

In some examples, the current detecting circuit 300 may include a first current detecting resistor RC1 to a third current detecting resistor RC3, a diode D, a first comparator CP1, and a hysteresis circuit HY.

The first current detecting resistor RC1 may be electrically connected to the second stage T2 of the current transformer 250.

In some examples, the first current detecting resistor RC1 is electrically connected to the second stage T2 of the current transformer 250, and the resonance current applied to the second stage T2 may be converted into resonance voltage Vr1 which has an opposite direction to the direction of the resonance current through the first current detecting resistor RC1.

For example, as shown in FIG. 4, the direction of the resonance current Ir flowing through the first stage T1 of the current transformer 250 may be opposite to the direction of the resonance voltage Vr1 applied to the first current detecting resistor RC1 through the second stage T2 of the current transformer 250.

The direction of the resonance voltage Vr1 is determined based on a reference (e.g., a ground G) when the resonance voltage Vr1 applied to the first current detecting resistor RC1 is measured.

The diode D may be electrically connected to the first current detecting resistor RC1.

In some examples, a first end of the diode D may be electrically connected to the first current detecting resistor RC1, and a second end of the diode D may be electrically connected to the second current detecting resistor RC2.

In some examples, the diode D may remove the negative voltage from the resonance voltage Vr1 converted through the first current detecting resistor RC1.

For example, based on voltage of a first end of the diode D being greater than voltage of a second end of the diode D, the diode D is turned on, and thus, the current flows from the first end of the diode D to the second end of the diode D, and based on voltage of the first end of the diode D being less than the voltage of the second end of the diode D, the diode D is turned off, and thus, the current may not flow through the diode D.

That is, as shown in FIGS. 5A and 6, when the resonance voltage Vr1 applied to the first current detecting resistor RC1 is (+), the diode D is turned on and the current I flows through the second current detecting resistor RC2 and the third current detecting resistor RC3, and the voltage Vr2 having the same magnitude as the voltage Vr1 applied to the first current detecting resistor RC1 may be applied to the second current detecting resistor RC2 and the third current detecting resistor RC3.

In some implementations, as shown in FIGS. 5B and 6, based on the resonance voltage Vr1 applied to the first current detecting resistor RC1 being (−), the diode D is turned off and the circuit is opened. Thus, the current I may not flow through the second current detecting resistor RC2 and the third current detecting resistor RC3, and the magnitude of the voltage Vr2 applied to each of the second current detecting resistor RC2 and the third current detecting resistor RC3 may be 0 V.

In some examples, resonance voltage Vr2 from which (−) voltage of the resonance voltage Vr1 applied to the first current detecting resistor RC1 is removed (i.e., voltage in a (+) section of the resonance voltage Vr1 and corresponding to a section in which the resonance current Ir is (−)) may be applied to the second current detecting resistor and the third current detecting resistor RC3.

The second current detecting resistor RC2 may be connected to the diode D electrically in series.

In some examples, a first end of the second current detecting resistor RC2 may be electrically connected to the diode D, and a second end of the second current detecting resistor RC2 may be electrically connected to the third current detecting resistor RC3.

In some examples, the second current detecting resistor RC2 may distribute the resonance voltage Vr2 from which the above-mentioned negative voltage is removed.

The third current detecting resistor RC3 may be connected to the second current detecting resistor RC2 electrically in series.

In some examples, a first end of the third current detecting resistor RC3 may be electrically connected to the second current detecting resistor RC2, and a second end of the third current detecting resistor RC3 may be electrically connected to the ground G.

Like the second current detecting resistor RC2, the third current detecting resistor RC3 may also distribute the resonance voltage Vr2 from which the above-mentioned negative voltage is removed.

In some examples, resonance voltage distributed to the third current detecting resistor RC3 may be applied to a positive input terminal of the first comparator CP1 (i.e., a (+) input terminal of the first comparator CP1). The voltage applied to the positive input terminal of the first comparator CP1 may be desired to be less than the operating voltage to operate the first comparator CP1 to distribute the resonance voltage Vr2 from which the negative voltage is removed to the second current detecting resistor RC2 and the third current detecting resistor RC3 and to apply the resonance voltage distributed to the third current detecting resistor RC3 to the positive input terminal of the first comparator CP1.

The first comparator CP1 may be electrically connected to the first node N1 between the second current detecting resistor RC2 and the third current detecting resistor RC3 to output the first voltage VO1.

In some examples, the first comparator CP1 may compare the resonance voltage applied to the positive input terminal with the first reference voltage Vref1 applied to the negative input terminal (e.g., (−) input terminal of the first comparator CP1), and may determine the first voltage VO1 based on a result of comparison of the resonance voltage applied to the positive input terminal with the first reference voltage Vref1 applied to the negative input terminal.

In some examples, the first reference voltage Vref1 may ideally be a ground voltage (i.e., 0 V), but may be set to be voltage having a specific magnitude in consideration of a voltage drop caused by leakage current or noise. In some examples, the first reference voltage Vref1 may be applied to the second reference resistor Rf2 when voltage V having a specific magnitude is distributed using a first reference resistor Rf1 and a second reference resistor Rf2.

As shown in FIG. 7, based on the magnitude of the resonance voltage V+ applied to the positive input terminal being equal to or greater than the magnitude of the voltage V− applied to the negative input terminal (for reference, the magnitude of the voltage V− is the same as Vref1 in FIG. 3), the first comparator CP1 may determine the value of the first voltage VO1 as the voltage value having the preset magnitude of, for example, 5V (i.e., in a high state).

In some implementations, based on the magnitude of the resonance voltage V+ applied to the positive input terminal being less than the magnitude of the voltage V− applied to the negative input terminal (for reference, the magnitude of voltage V− is the same as Vref1 in FIG. 13), the first comparator CP1 may determine the value of the first voltage VO1 as voltage in a low state (e.g., 0V).

FIG. 7 shows an example of a hysteresis circuit HY that is not used for the first comparator CP1, and based on a state being continually maintained in which the magnitude of the resonance voltage V+ applied to the positive input terminal becomes close to the magnitude of the voltage V− applied to the negative input terminal, a floating section FL may be generated.

"Floating" refers that the value of the first voltage VO1 output from the first comparator CP1 is a voltage value other than voltage in the high state (e.g., a preset magnitude of voltage value of 5 V) or voltage in the low state (e.g., 0 V).

The first comparator CP1 may include a complementary metal-oxide semiconductor (CMOS) type comparator TLV3502 and the floating section FL shown in FIG. 7 may be generated. The current detecting circuit 300 may include a hysteresis circuit HY to restrict the generation of the floating section FL. In some cases, the comparator may include an operational amplifier (op amp) that is manufactured by a CMOS process technology.

In some examples, the hysteresis circuit HY may be electrically connected between the first node N1 and the output terminal of the first comparator C.

In some examples, the hysteresis circuit HY may include a first hysteresis resistor RH1 electrically connected between the first node N1 and the positive input terminal of the first comparator CP1 and a second hysteresis resistor RH2 in which a first end of the second hysteresis resistor is electrically connected between the first hysteresis resistor RH1 and the positive input terminal and a second end of the second hysteresis resistor RH2 is electrically connected to the output terminal of the first comparator CP1.

In some examples, the resonance voltage Vr2 from which the negative voltage is removed by the diode D may be applied to the positive input terminal of the first comparator CP1 through a voltage distribution process performed by the second current detecting resistor RC2 and the third current detecting resistor RC3 and the first hysteresis resistor RH1 and the second hysteresis resistor RH2.

In some examples, as shown in FIG. 8, the circuit shown at an upper portion in FIG. 8 may be converted into an equivalent circuit, for example, the circuit shown at a lower portion in FIG. 8. In some examples, referring to the circuit shown at the lower portion in FIG. 8, the resonance voltage Vr2 and the first voltage VO1 have a parallel configuration.

Due to this parallel configuration, the voltage Vin applied to the first node N1 may be affected by the first voltage VO1 as well as the resonance voltage Vr2. Further, due to the influence of the first voltage VO1, a function of the hysteresis circuit HY (e.g., restricting the generation of the floating section FL) may be difficult to be properly performed.

Voltage Vin may be defined by the following <Equation 1>. In some examples, in the following, (R|| R') refers to a parallel composite resistance value between R and R'.

$$Vin = \frac{RC3\|(RH1+RH2)}{RC2+\left(RC3\|\left(\begin{matrix}RH1+\\RH2\end{matrix}\right)\right)}Vr2+\frac{(RC2\|RC3)}{\begin{matrix}(RH1+RH2)+\\(RC2\|RC3)\end{matrix}}VO1 \quad \text{(Equation 1)}$$

As defined in Equation 1, a sum (e.g., RH1+RH2) of a resistance value of the first hysteresis resistor and a resistance value of the second hysteresis resistor may be greater to reduce the effect of the first voltage VO1 on voltage Vin.

In some examples, in an example of the induction heating device 1, the values of the first hysteresis resistor RH1 and the second hysteresis resistor RH2 may be set to be greater than the values of the second current detecting resistor RC2 and the third current detecting resistor RC3 to thereby perform a function of the hysteresis circuit HY (e.g., the restriction of the generation of the floating section FL) by reducing the effect of the first voltage VO1.

As shown in FIG. 9, the first comparator CP1 to which the hysteresis circuit HY is electrically connected may have two reference voltages, in contrast to a general comparator. In some examples, the first comparator CP1 has a hysteresis-type output voltage value graph based on two reference voltages.

That is, in the case of a general comparator, the output voltage value is determined to be in the high state or the low state based on one reference voltage applied to the negative input terminal.

In some examples, the first comparator CP1 for which the hysteresis circuit HY is used may have a plus threshold reference voltage Vth+ to convert the output voltage value (e.g., the first voltage VO1) from the voltage in the low state VOL to the voltage in the high state VOH and minus threshold reference voltage Vth− to change the output voltage value VO1 from the voltage in the high state VOH to the voltage in the low state VOL.

In some examples, the first comparator CP1 may calculate a plus threshold reference voltage Vth+ and a minus threshold reference voltage Vth− based on the first reference voltage Vref1 applied to the negative input terminal, may compare the resonance voltage V+ (e.g., Vx in FIG. 8) applied to the positive input terminal through the voltage distribution process with the plus threshold reference voltage Vth+ or the minus threshold reference voltage Vth− and may determine the value of the first voltage VO1 based on the result of comparison of the resonance voltage V+ (e.g., Vx in FIG. 8) applied to the positive input terminal through the voltage distribution process with the plus threshold reference voltage Vth+ or the minus threshold reference voltage Vth−.

In some examples, in the first comparator CP1 for which the hysteresis circuit HY is used, the voltage V+ (e.g., Vx in FIG. 8) applied to the positive input terminal may be the first reference voltage Vref1 to change the state of the output voltage value VO1 from the low state VOL to the high state VOH (i.e., for the voltage V+ to change, there is a time point when the voltage V+ is equal to the first reference voltage Vref1). Conditions of the voltage Vin to satisfy that voltage Vx becomes the first reference voltage Vref1 are defined in the following Equation 2 and Equation 3.

$$Vx = Vref1 = \frac{RH2}{RH1 + RH2} Vin + \frac{RH1}{RH1 + RH2} VOL \quad \text{(Equation 2)}$$

$$Vin = \frac{RH1 + RH2}{RH2} Vref1 - \frac{RH1}{RH2} VOL \quad \text{(Equation 3)}$$

In some examples, the plus threshold reference voltage Vth+ may be defined as described in Equation 4 below using the above Equation 3.

$$Vth += Vin = \frac{RH1}{RH2}(Vref1 - VOL) + Vref1 \quad \text{(Equation 4)}$$

In some examples, in the first comparator CP1 for which the hysteresis circuit HY is used, the voltage V+ (e.g., voltage Vx in FIG. 8) applied to the positive input terminal may be the above-mentioned first reference voltage Vref1 to change the state of the output voltage value VO1 from the high state VOH to the low state VOL (i.e., for the voltage V+ to change, there may be desired to have a time point when the voltage V+ is equal to the first reference voltage Vref1). Conditions of Vin to satisfy that voltage Vx becomes the first reference voltage Vref1 in FIG. 8 are defined in Equation 5 and Equation 6 below.

$$Vx = Vref1 = \frac{RH2}{RH1 + RH2} Vin + \frac{RH1}{RH1 + RH2} VOH \quad \text{Equation 5}$$

$$Vin = \frac{RH1 + RH2}{RH2} Vref1 - \frac{RH1}{RH2} VOH \quad \text{Equation 6}$$

In some examples, the minus threshold reference voltage Vth− may be defined as described in Equation 7 below using the Equation 6.

$$Vth -= Vin = \frac{RH1}{RH2}(Vref1 - VOH) + Vref1 \quad \text{(Equation 7)}$$

The first comparator CP1 for which the hysteresis circuit HY is used has two reference voltages (e.g., plus threshold reference voltage Vth+ and minus threshold reference voltage Vth−). As shown in FIG. 10, based on the voltage V+ applied to the positive input terminal being equal to or greater than the plus threshold reference voltage Vth+ (i.e., based on V+, which is less than Vth+, becoming equal to or greater than Vth+), the first comparator CP1 outputs the value of the first voltage VO1 in the high state, and based on the voltage V+ applied to the positive input terminal being equal to or less than the minus threshold reference voltage Vth− (i.e., based on V+, which is greater than Vth−, becoming equal to or less than Vth−), the first comparator CP1 may output the value of the first voltage VO1 in the low state.

FIG. 7 shows an example of a hysteresis circuit HY that is not used for the first comparator CP1. FIG. 10 shows an example of a hysteresis circuit HY that is used for the first comparator CP1.

That is, the induction heating device 1 includes the hysteresis circuit HY used for the first comparator CP1, and the input and output of the first comparator CP1 is implemented as shown in FIG. 10. The first comparator CP1 may help to prevent the floating phenomenon shown in FIG. 7.

In some examples, the voltage detecting circuit 350 is electrically connected to the inverter IV to receive the switching voltage Vs2 applied to the second switching element S2, and may output the second voltage VO2 based on the received switching voltage Vs2. In some examples, the voltage detecting circuit 350 may output the second voltage VO2 to provide the AND circuit 400 with the second voltage VO2.

In some examples, the voltage detecting circuit 350 may include the first voltage detecting resistor RV1, the second voltage detecting resistor RV2, and a second comparator CP2.

The first voltage detecting resistor RV1 may be electrically connected to the second switching element S2.

In some examples, a first end of the first voltage detecting resistor RV1 may be electrically connected to the second switching element S2, and a second end of the first voltage detecting resistor RV1 may be electrically connected to the second voltage detecting resistor RV2.

In some examples, the first voltage detecting resistor RV1 is used to distribute the switching voltage Vs2 provided by the inverter IV to the voltage detecting circuit 350.

The second voltage detecting resistor RV2 and the first voltage detecting resistor RV1 may be connected to each other electrically in series.

In some examples, a first end of the second voltage detecting resistor RV2 may be electrically connected to the first voltage detecting resistor RV1, and a second end of the second voltage detecting resistor RV2 may be electrically connected to the ground G.

The second voltage detecting resistor RV2 is also used for voltage distribution of the above-described switching voltage Vs2, like the first voltage detecting resistor RV1.

In some examples, the switching voltage Vs2 provided by the inverter IV to the voltage detecting circuit 350 is distributed to the first voltage detecting resistor RV1 and the second voltage detecting resistor RV2 and the switching voltage distributed to the second voltage detecting resistor RV2 may be applied to the positive input terminal of the second comparator CP2 (e.g., (+) input terminal of the second comparator CP2). In some examples, the voltage applied to the positive input terminal of the second comparator CP2 may be less than the operating voltage to operate the second comparator CP2 to distribute the switching voltage Vs2 to the first voltage detecting resistor RV1 and the second voltage detecting resistor RV2 and to apply the switching voltage distributed to the second voltage detecting resistor RV2 to the positive input terminal of the second comparator CP2.

The second comparator CP2 may be electrically connected to the second node N2 between the first voltage detecting resistor RV1 and the second voltage detecting resistor RV2 to output the second voltage VO2.

In some examples, the second comparator CP2 compares the switching voltage applied to the positive input terminal with the second reference voltage Vref2 applied to the negative input terminal (e.g., the (−) input terminal of the second comparator CP2) and may determine the value of the second voltage VO2 based on the result of comparison of the switching voltage applied to the positive input terminal with the second reference voltage Vref2 applied to the negative input terminal.

In some examples, the second reference voltage Vref2 is ideally ground voltage (i.e., 0 V) but may be set to be the voltage having the specific magnitude in consideration of the voltage drop caused by leaking current or the noise. In some examples, the second reference voltage Vref2 may be applied to a fourth reference resistor Rf4 when the voltage V having the specific magnitude is distributed using the third reference resistor Rf3 and the fourth reference resistor Rf4.

As shown in FIG. 11, based on the magnitude of the switching voltage V+ applied to the positive input terminal being greater than or equal to the voltage V− applied to the negative input terminal (for reference, a magnitude of V− is the same as the second reference voltage Vref2 in FIG. 3), the second comparator CP2 may determine the value of the second voltage VO2 as a voltage value (e.g., 5V) having a predetermined magnitude (e.g., in a high state).

In some implementations, based on the magnitude of the switching voltage V+ applied to the positive input terminal being less than the magnitude of the voltage V− applied to the negative input terminal (for reference, the magnitude of V− is the same as the second reference voltage Vref2 in FIG. 3), the second comparator CP2 may determine the value of the second voltage VO2 as the voltage in a low state (e.g., 0 V).

In some examples, in contrast to the first comparator CP1, the switching voltage Vs2 having the shape of a square wave is distributed and applied to the positive input terminal of the second comparator CP2, and the magnitude of the switching voltage V+ applied to the positive input terminal is significantly different from the magnitude of the voltage V− applied to the negative input terminal instantaneously at a specific time point to thereby occur no floating.

In some examples, the hysteresis circuit is not used for the second comparator CP2.

In some examples, the second comparator CP2 may include a CMOS type comparator like the first comparator CP1, but is not limited thereto.

The AND circuit 400 may receive the first voltage VO1 and the second voltage VO2 from the current detecting circuit 300 and the voltage detecting circuit 350, respectively, and may output the pulse P based on the received first voltage VO1 and second voltage VO2. In some examples, the AND circuit 400 may output the pulse P to provide the controller 450 with the pulse P.

In some examples, the AND circuit 400 may include the first pulse generation resistor RP1 and the third pulse generation resistor RP3 and a third comparator CP3.

The first pulse generation resistor RP1 may be electrically connected to an output terminal of the current detecting circuit 300 (e.g., an output terminal of the first comparator CP1.

In some examples, a first end of the first pulse generation resistor RP1 may be electrically connected to the output terminal of the first comparator CP1 and a second end of the first pulse generation resistor RP1 may be electrically connected to the fourth node N4.

The fourth node N4 is disposed between the third node N3 between the second pulse generation resistor RP2 and the third pulse generation resistor RP3 and the first pulse generation resistor RP1.

The second pulse generation resistor RP2 may be electrically connected to an output terminal of the voltage detecting circuit 350 (e.g., an output terminal of the second comparator CP2).

In some examples, a first end of the second pulse generation resistor RP2 may be connected to the output terminal of the second comparator CP2 and a second end of the second pulse generation resistor RP2 may be connected to the third node N3.

The third node N3 is disposed between the second pulse generation resistor RP2 and the third pulse generation resistor RP3.

The third pulse generation resistor RP3 may be electrically connected between the second pulse generation resistor RP2 and ground G.

In some examples, a first end of the third pulse generation resistor RP3 may be electrically connected to the third node N3 and a second end of the third pulse generation resistor RP3 may be electrically connected to the ground G.

In some examples, the third pulse generation resistor RP3 distributes the voltage with the first pulse generation resistor RP1 and the second pulse generation resistor RP2 and the voltage Vadd applied to the positive input terminal of the third comparator CP3 (e.g., the (+) input terminal of the third comparator CP3) is less than the operating voltage to operate the third comparator CP3.

For example, the first voltage VO1 output from the current detecting circuit 300 is applied to the fourth node N4 through a first voltage distribution process by the first pulse generation resistor RP1 and the third pulse generation resistor RP3. The second voltage VO2 output from the voltage detecting circuit 350 may be applied to the fourth node N4 through a second voltage distribution process performed by the first pulse generation resistor RP1 and the third pulse generation resistor RP3. In some examples, the voltage applied to the fourth node N4 through the first voltage distribution process and the voltage applied to the fourth node N4 through the second voltage distribution process are combined with each other and the combined voltages may be applied to the positive input terminal of the third comparator CP3.

The voltage Vadd applied to the positive input terminal of the third comparator CP3 may be defined as described in Equation 8 below.

$$Vadd = \frac{(RP2||RP3)}{RP1 + (RP2||RP3)} VO1 + \frac{(RP1||RP3)}{RP2 + (RP1||RP3)} VO2 \quad \text{(Equation 8)}$$

In some examples, the third comparator CP3 is electrically connected to the fourth node N4 between the third node N3 and the first pulse generation resistor RP1, where the third node N3 is disposed between the second pulse generation resistor RP2 and the third pulse generation resistor RP3, to output the pulse P.

In some examples, the third comparator CP3 may compare the voltage applied to the positive input terminal (e.g., the (+) input terminal of the third comparator CP3) with the third reference voltage Vref3 applied to the negative input terminal (e.g., the (−) input terminal of the third comparator CP3) and may generate the pulse P based on the result of comparison of the voltage applied to the positive input terminal with the third reference voltage Vref3 applied to the negative input terminal.

In some examples, assuming that a resistance value of the first pulse generation resistor RP1 and a resistance value of the second pulse generation resistor RP2 is 100 KΩ, respectively, and a resistance value of the third pulse generation resistor RP3 is 18 KΩ the voltage Vadd is 0.66 V when the first voltage VO1 is 5 V and the second voltage VO2 is 0 V, the voltage Vadd is 0.66V when the first voltage VO1 is 0 V and the second voltage VO2 is 5 V, and the voltage Vadd may be 1.32 V when the first voltage VO1 is 5 V and the second voltage VO2 is 5 V.

In this case, the magnitude of the third reference voltage Vref3 may be set to be in a range of 0.66 V to 1.32 V (e.g., 1 V) and the pulse P may be output as the pulse in the high state (e.g., "1" or 'the voltage value having the specific magnitude') only when the first voltage VO1 and the second voltage VO2 are voltages in the high state (e.g., 5V). In some examples, the pulse P in the low state (e.g., "0") may be output in other cases (e.g., in the case of any one of the first voltage VO1 and the second voltage VO2 in the low state).

That is, when both the first voltage VO1 and the second voltage VO2 are in the high state, the AND circuit 400 outputs a pulse P in the high state, and when any one of the first voltage VO1 and the second voltage VO2 is in the low state, the AND circuit 400 may output the pulse P in the low state.

In some examples, the third reference voltage Vref3 may be applied to a sixth reference resistor Rf6 when voltage V having the specific magnitude is distributed using a fifth reference resistor Rf5 and the sixth reference resistor Rf6.

In some examples, based on the magnitude of the voltage Vadd applied to the positive input terminal being greater than or equal to the magnitude of the third reference voltage Vref3 applied to the negative input terminal, the third comparator CP3 may generate the pulse P in the high state.

In some implementations, based on the magnitude of the voltage Vadd applied to the positive input terminal being less than the magnitude of the third reference voltage Vref3 applied to the negative input terminal, the third comparator CP3 may generate the pulse P in a low state.

A width (θ) (see FIG. 12) of the pulse P output from the AND circuit 400 represents a phase difference between the resonance current Ir applied to the working coil WC and the switching voltage Vs2 applied to the second switching element S2 (i.e., time delay between a zero-crossing point of the resonance current Ir and a zero-crossing point of the switching voltage Vs2).

In some examples, like the second comparator CP2, the voltage Vadd having the shape of a square wave is applied to the positive input terminal of the third comparator CP3 and the floating may not be generated by the third comparator CP3.

In some examples, the hysteresis circuit is not used for the third comparator CP3.

In some examples, the third comparator CP3 may include a CMOS type comparator like the first comparator CP1, but is not limited thereto.

The current detecting circuit 300 and the voltage detecting circuit 350 output the first voltage VO1 and the second voltage VO2 through the above-described process, and the AND circuit 400 outputs the pulse P based on the first voltage VO1 and the second voltage VO2 received from the current detecting circuit 300 and the voltage detecting circuit 350. This mechanism is shown in FIG. 12 in brief.

In some examples, the above-described mechanism is simply and clearly shown in FIG. 12 based on assumption that the first reference voltage Vref1 and the second reference voltage Vref2 are each 0V.

The controller 450 may control the switching operation of the inverter IV. In some examples, when the object is not present above the working coil WC, the controller 450 may determine that the object is in a no-load state without determination with respect to the material of the object, and when the object is present above the working coil WC, the controller 450 may determine the material of the object present above the working coil WC.

In some examples, the controller 450 may receive the pulse P from the AND circuit 400 and may determine the material of the object present above the working coil WC based on the width (θ) of the received pulse P.

In some examples, the controller 450 may be electrically connected to the second stage T2 of the current transformer 250 or the current detecting circuit 300. Accordingly, the controller 450 may improve accuracy in operation of detecting the magnitude of the resonance current whose magnitude is changed and flowing through the second stage T2 of the current transformer 250 or the current detecting circuit 300 (e.g., detecting the magnitude of the resonance current whose magnitude is changed based on the voltage applied to the first node N1 in FIG. 3), calculating the magnitude of the resonance current (e.g., the resonance current flowing through the working coil WC) applied to the working coil WC based on the detected magnitude of the resonance current (i.e., the magnitude of the resonance current the magnitude of which is changed), and determining the material of the object present above the working coil WC based on a result of the calculation of the magnitude of the resonance current.

That is, the controller 450 determines the material of the object based on the width (θ) of the pulse P and the magnitude of the resonance current.

The operation of determining the material of the object may include an operation of determining the material of the object and presence or absence of the object.

For reference, when the object is disposed above the working coil WC, the overall resistance may increase due to the self-resistance of the object, and thus, the magnitude of the resonance current flowing through the working coil WC may be changed (i.e., a degree of attenuation of the resonance current may be increased). That is, the self-resistance of the object depends on the material of the object, and accordingly, the magnitude of the resonance current flowing through the working coil WC also depends on the material of the object. Based on this principle, magnitude information related to the resonance current is used in the operation of determining the material of the object.

In some examples, FIG. 13 shows that the detection accuracy with respect to the material of the object may be improved when the material of the object is determined by the controller 450 based on both the width (θ) of the pulse and the magnitude of the resonance current compared to determination of the material of the object performed by the controller 450 based on any one of the width (θ) of the pulse P and the magnitude of the resonance current.

As shown in FIG. 13, in the case of the object made of STS430 material which is made of ferromagnetic, the magnitude of the resonance current in the state in which the object is present above the working coil WC (presented as 1301) is similar to the magnitude of the resonance current in the state in which the object is not present above the working coil WC (presented as 1302), and it is difficult to distinguish them from each other. In some examples, the magnitude of the resonance current applied to the object made of ferromagnetic STS304 material (presented as 1303) is similar to the magnitude of the resonance current applied to the object made of the non-magnetic material (presented as 1304), and thus, it is difficult to distinguish them from each other.

However, as shown in FIG. 13, the object made of the ferromagnetic STS430 material may be clearly distinguished from a state of no-load with respect to the phase difference (i.e., the width (θ) of the pulse P). In some examples, the object made of ferromagnetic STS304 material may be clearly distinguished from the object made of the non-magnetic material with respect to the phase difference (e.g., the width (θ) of the pulse P).

In some examples, no load 1301 and non-magnetic material 1304, STS304 1303, and small object 1305, and Steel 1306 and STS430 1302 are not clearly distinguishable from one another in terms of phase difference (e.g., width of the pulse P) but is clearly distinguishable from one another in terms of the magnitude of the resonance current. That is, in some implementations, the controller 450 may determine the material of the object present above the working coil WC based on the magnitude of the resonance current received from the second stage T2 of the current transformer 250 or the current detecting circuit 300 and the width (θ) of the pulse P received from the AND circuit 400 to thereby improve the detection accuracy with respect to the material of the object.

An example of the induction heating device 1 includes the above-described configuration and features. Another example of an induction heating device 2 shown in FIG. 14 is described below with reference to FIGS. 14 to 16.

Figure 14:
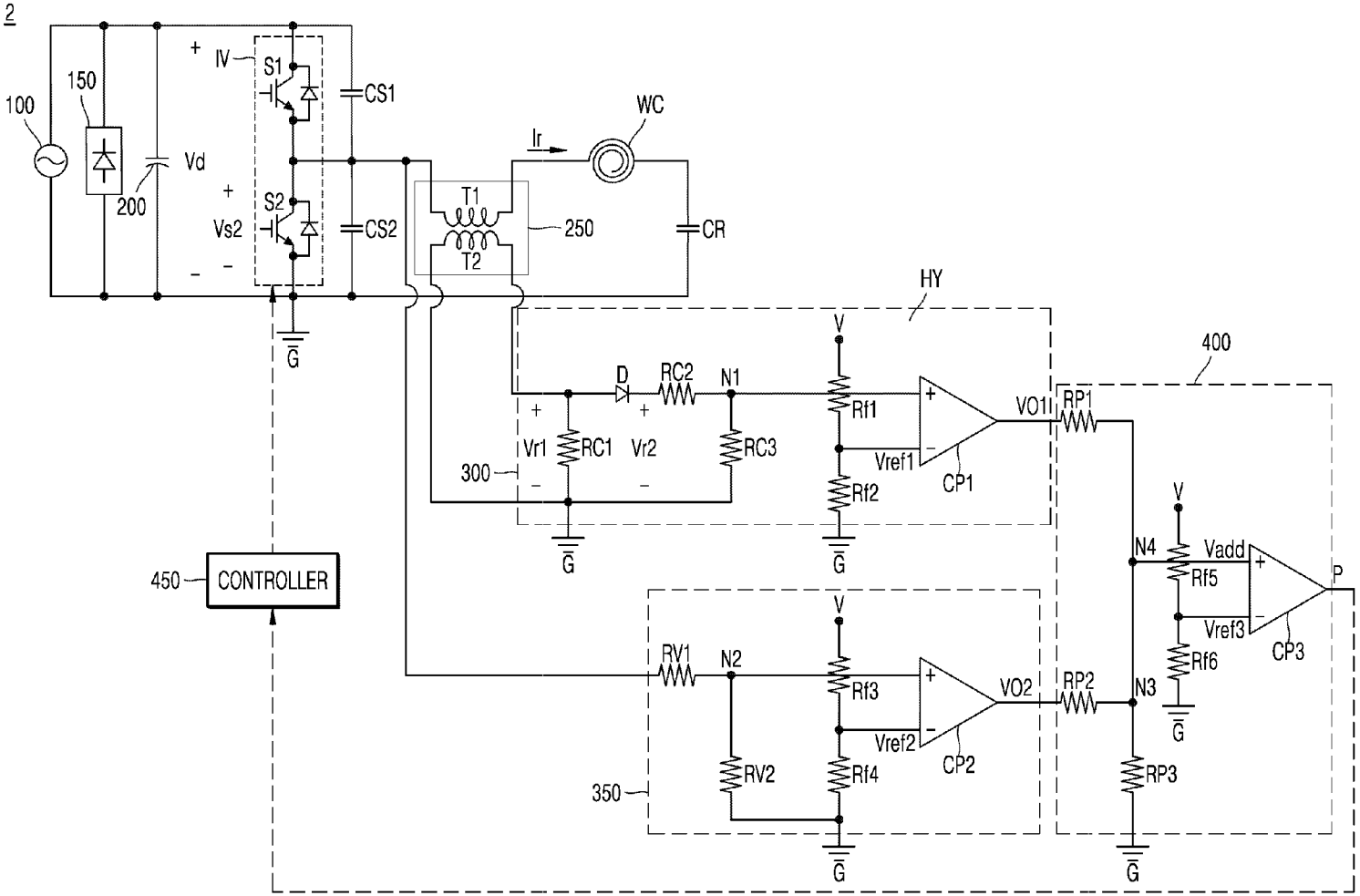
FIG. 14 is a circuit diagram showing another example of an induction heating device.
Figure 15:
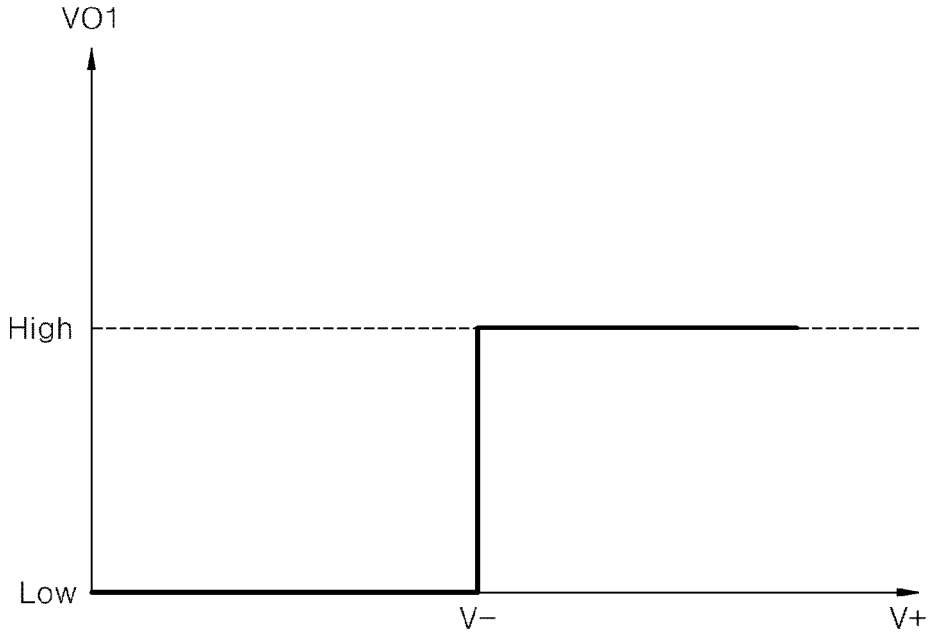
FIGS. 15 and 16 respectively show examples of input and output of a first comparator shown in FIG. 14.
Figure 16:
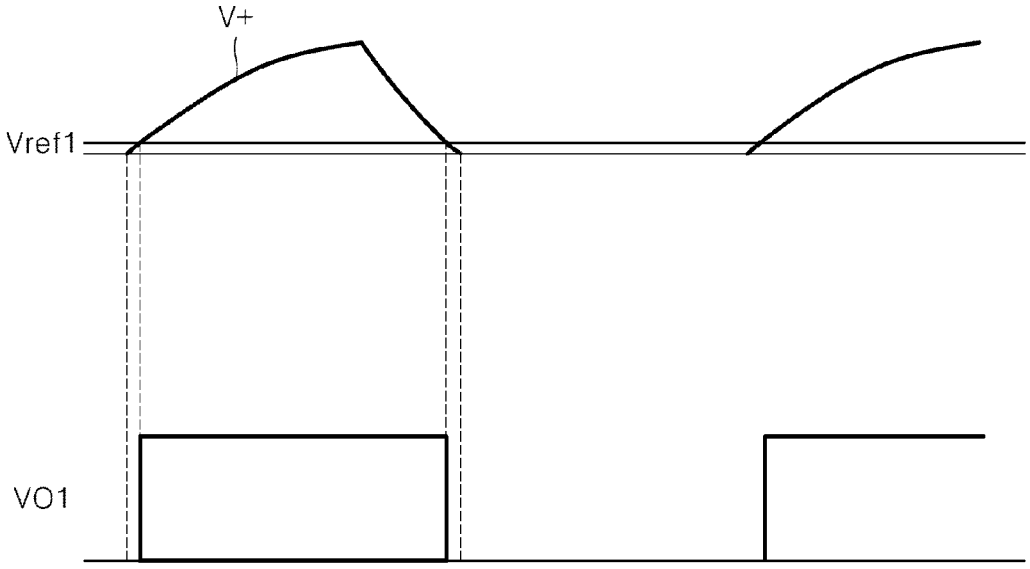

FIG. 14 is a circuit diagram showing another example of the induction heating device 2. FIGS. 15 and 16 respectively show examples of input and output of a first comparator shown in FIG. 14.

In some examples, the induction heating device 2 shown in FIG. 14 may be only different from the induction heating device 1 shown in FIG. 3 with respect to types of the first comparator CP1 and the hysteresis circuit being used for the first comparator CP1. The induction heating device 2 may be otherwise the same as the induction heating device 1 shown in FIG. 3 with respect to other configurations and features. Thus, the difference between the induction heating device 2 shown in FIG. 14 with the induction heating device 1 shown in FIG. 3 is mainly described.

In some implementations, referring to FIGS. 14 to 16, in contrast to the induction heating device 1 shown in FIG. 3, the induction heating device 2 may include an open drain type first comparator CP1 and may not include the hysteresis circuit.

For example, the first comparator CP1 (see FIG. 14) used for the induction heating device 2 shown in FIG. 14, may be an open drain type comparator and have a low reaction speed (i.e., an operating speed) than a low reaction speed (i.e., an operating speed) of the CMOS type comparator CP1 (see FIG. 3), and may not generate floating.

In some examples, the output terminal of an open drain type comparator is not connected to a circuit inside the comparator (i.e., also not connected to an operating voltage source of the comparator), and output voltage is generated through a circuit (including voltage source and resistance) provided outside the comparator. In some examples, only certain magnitude of voltage (in the high state) or 0 V (in the low state) exists in the output voltage of the open drain type comparator and no floating occurs.

In some examples, the CMOS type comparator may have a faster reaction speed than a reaction speed of the open drain type comparator and the output terminal of the CMOS type comparator is connected to the operating voltage source of the comparator through an internal circuit to thereby output abnormal voltage (i.e., to occur the floating) other than the voltage in the high state or the low state during abnormal operation of the internal circuit.

That is, the first comparator CP1 included in the induction heating device 2 shown in FIG. 14 corresponds to an open drain type comparator in which no floating phenomenon occurs, and thus, no hysteresis circuit is desired. In the induction heating device 2 in FIG. 14, the hysteresis circuit is not used for the first comparator CP1.

In some examples, in the induction heating device 2 shown in FIG. 14, as the hysteresis circuit is not used for the first comparator CP1, the material cost desired to provide the hysteresis circuit may be reduced compared to the induction heating device 2 shown in FIG. 3.

In some examples, each of the second comparator CP2 and the third comparator CP3 may include a CMOS type comparator and may also include an open drain type comparator. A first one of the second comparator CP2 and the third comparator CP3 may include the CMOS type comparator, and a second one of the second comparator CP2 and the third comparator CP3 may include an open drain type comparator.

In some implementations, the induction heating device 2 shown in FIG. 14 may include both the second comparator CP2 and the third comparator CP3 that are CMOS type comparators.

In some examples, the induction heating device 2 may include the open drain type first comparator CP1. As shown in FIGS. 15 and 16, based on the magnitude of the resonance voltage V+ applied to the positive input terminal of the first comparator CP1 (e.g., the (+) input terminal of the first comparator CP1 in FIG. 14) being equal to or greater than the magnitude of the voltage V− (for reference, the magnitude of voltage V− is the same as the first reference voltage Vref1 in FIGS. 14 and 16) applied to the negative input terminal (e.g., the (−) input terminal of the first comparator CP1 in FIG. 14), the first comparator CP1 may determine the value of the first voltage VO1 14 as the voltage in the high state.

In some examples, based on the magnitude of the resonance voltage V+ applied to the positive input terminal of the first comparator CP1 (e.g., the (+) input terminal of the first comparator CP1 in FIG. 14) being less than the magnitude V− voltage applied to the negative input terminal (e.g., the (−) input terminal of the first comparator CP1 in FIG. 14) (the magnitude of V− is the same as the first reference voltage Vref1 in FIGS. 14 and 16), the first comparator CP1 may determine the value of the first voltage VO1 to be in the low state.

In some examples, the first reference voltage Vref1 may be set on the same principle as shown in FIG. 3.

In some implementations, the induction heating devices 1 and 2 improve the detection accuracy with respect to the material of the object and the presence or the absence of the object to thereby provide users with an optimum output for each material. The possibility of malfunction or breakage of the induction heating device itself occurring due to the incorrect determination on the material of the object may be minimized. Furthermore, user satisfaction may be improved by providing the users with the optimal output for each material and the reliability of the induction heating device may be improved by minimizing the possibility of the malfunction or the breakage of the induction heating device itself.

While the present disclosure has been described with reference to the drawings exemplified as above, the present disclosure is not limited to the implementations and drawings disclosed herein, and various modifications can be made by those skilled in the art within the scope of the technical idea of the present disclosure. Further, even if working effects obtained based on the configurations of the present disclosure are not explicitly described while describing implementations of the present disclosure hereinabove, it is needless to say that effects predictable based on configurations have to be recognized.

Other implementations are within the scope of the following claims.

What is claimed is:

1. An induction heating device, comprising:

a working coil;

an inverter comprising a first switching element and a second switching element that are configured to perform a switching operation and to apply resonance current to the working coil based on the switching operation;

a current transformer comprising a first coil connected to the inverter and the working coil that are configured to change a magnitude of the resonance current in the first coil;

a current detecting circuit electrically connected to the current transformer, the current detecting circuit being configured to receive a first resonance current which is the resonance current having changed magnitude and output a first voltage based on the received first resonance current;

a voltage detecting circuit electrically connected to the inverter, the voltage detecting circuit being configured to receive a switching voltage applied to the second switching element and to output a second voltage based on the received switching voltage;

an AND circuit configured to receive the first voltage and the second voltage and to output a pulse based on the received first voltage and the received second voltage; and a controller configured to:

control the switching operation, receive the output pulse from the AND circuit, and determine a material of an object on the working coil based on a width of the received pulse.

2. The induction heating device of claim 1, wherein the current detecting circuit comprises:

a first current detecting resistor electrically connected to a second coil of the current transformer;

a diode electrically connected to the first current detecting resistor;

a second current detecting resistor electrically connected to the diode in series;

a third current detecting resistor including a first end electrically connected to the second current detecting resistor and a second end connected to a ground; and a first comparator connected to a first node between the second current detecting resistor and the third current detecting resistor, the first comparator being configured to output the first voltage.

3. The induction heating device of claim 2, wherein the current transformer further comprises a second coil that a number of coil windings of the second coil is greater than a number of coil windings of the first coil and the resonance current having the magnitude less than the magnitude of the resonance current in the first coil is applied.

4. The induction heating device of claim 3, wherein the resonance current applied to the second coil is converted into a resonance voltage having a direction opposite to the resonance current through the first current detecting resistor, wherein the diode is configured to remove a negative voltage from the resonance voltage converted through the first current detecting resistor, wherein the resonance voltage from which the negative voltage is removed is distributed to the second current detecting resistor and the third current detecting resistor, wherein the resonance voltage distributed to the third current detecting resistor is applied to a positive input terminal of the first comparator, and wherein the first comparator is configured to compare a resonance voltage applied to the positive input terminal with a first reference voltage applied to a negative input terminal, and determine a value of the first voltage based on the comparison.

5. The induction heating device of claim 4, wherein the first comparator is configured to, based on a comparison between magnitude of the resonance voltage applied to the positive input terminal and a magnitude of the first reference voltage applied to the negative input terminal, determine a state of the value of the first voltage.

6. The induction heating device of claim 3, wherein the current detecting circuit further comprises a hysteresis circuit electrically connected between the first node and an output terminal of the first comparator, the hysteresis circuit comprising:

a first hysteresis resistor electrically connected between the first node and a positive input terminal of the first comparator; and a second hysteresis resistor having a first end electrically connected to the first hysteresis resistor and the positive input terminal, and a second end electrically connected to the output terminal of the first comparator.

7. The induction heating device of claim 6, wherein the resonance current applied to the second coil is converted into a resonance voltage having a direction opposite to a direction of the resonance current through the first current detecting resistor, wherein the diode is configured to remove a negative voltage from the resonance voltage converted through the first current detecting resistor, wherein the resonance voltage from which the negative voltage is removed is applied to a positive input terminal of the first comparator through a voltage distribution process by the second current detecting resistor, the third current detecting resistor, the first hysteresis resistor, and the second hysteresis resistor, and wherein the first comparator is configured to calculate a plus threshold reference voltage and a negative threshold reference voltage based on a first reference voltage applied to a negative input terminal, compare the resonance voltage applied to the positive input terminal through the voltage distribution process with the plus threshold reference voltage or the minus threshold reference voltage, and determine a value of the first voltage based on the comparison.

8. The induction heating device of claim 7, wherein the first comparator is configured to, based on a comparison between a magnitude of the resonance voltage applied to the positive input terminal and a magnitude of the plus threshold reference voltage, determine a state of the value of the first voltage.

9. The induction heating device of claim 1, wherein the voltage detecting circuit comprises:

a first voltage detecting resistor electrically connected to the second switching element;

a second voltage detecting resistor having a first end electrically connected to the first voltage detecting resistor and a second end electrically connected to a ground; and a second comparator connected to a second node between the first voltage detecting resistor and the second voltage detecting resistor, the second comparator being configured to output the second voltage.

10. The induction heating device of claim 9, wherein the switching voltage is distributed to the first voltage detecting resistor and the second voltage detecting resistor, wherein the switching voltage distributed to the second voltage detecting resistor is applied to a positive input terminal of the second comparator, and wherein the second comparator is configured to compare the switching voltage applied to the positive input terminal with a second reference voltage applied to a negative input terminal, and determine a value of the second voltage based on the comparison.

11. The induction heating device of claim 10, wherein the second comparator is configured to, based on a comparison between a magnitude of the switching voltage applied to the positive input terminal and a magnitude of the second reference voltage applied to the negative input terminal, determine a state of the value of the second voltage.

12. The induction heating device of claim 1, wherein the AND circuit comprises:

a first pulse generation resistor electrically connected to an output terminal of the current detecting circuit;

a second pulse generation resistor electrically connected to an output terminal of the voltage detecting circuit;

a third pulse generation resistor electrically connected the second pulse generation resistor and a ground; and a third comparator electrically connected to a fourth node disposed between a third node and the first pulse generation resistor, the third node disposed between the third pulse generation resistor and the second pulse generation resistor, and the third comparator being configured to output the pulse.

13. The induction heating device of claim 12, wherein the first voltage output from the current detecting circuit is applied to the fourth node through a first voltage distribution process by the first pulse generation resistor, the second pulse generation resistor, and the third pulse generation resistor, wherein the second voltage output from the voltage detecting circuit is applied to the fourth node through a second voltage distribution process by the first pulse generation resistor, the second pulse generation resistor, and the third pulse generation resistor, wherein the voltage applied to the fourth node through the first voltage distribution process and the voltage applied to the fourth node through the second voltage distribution process are combined and applied to a positive input terminal of the third comparator, and wherein the third comparator is configured to compare the voltage applied to the positive input terminal with a third reference voltage applied to a negative input terminal, and generate the pulse based on the comparison.

14. The induction heating device of claim 13,

Wherein the third comparator is configured to generate the pulse in a high state or a low state, based on a comparison between a magnitude of the voltage applied to the positive input terminal and a magnitude of the third reference voltage applied to the negative input terminal.

15. The induction heating device of claim 1, wherein a width of the output pulse from the AND circuit represents a phase difference between the resonance current applied to the working coil and the switching voltage applied to the second switching element.

16. The induction heating device of claim 1, wherein the controller is connected to a second coil included in the current transformer or to the current detecting circuit, and the controller is configured to:

detect the magnitude of the first resonance current in the second coil or the current detecting circuit, calculate the magnitude of the resonance current applied to the working coil based on the detected magnitude of the first resonance current, and provide an improved accuracy in determining the material of the object based on the calculated magnitude of resonance current.

17. The induction heating device of claim 1, wherein the controller is configured to determine, based on a presence of the object on the working coil, the material of the object or that the object is in a no-load state without the determination of the material of the object.

18. The induction heating device of claim 1, wherein the AND circuit is configured to output the pulse in a high state or low state based on a state of the first voltage and a state of the second voltage.

19. The induction heating device of claim 1, further comprising:

a resonance capacitor connected to the working coil; and a plurality of snubber capacitors electrically connected to the inverter, wherein the plurality of snubber capacitors comprises a first snubber capacitor electrically connected to the first switching element and a second snubber capacitor electrically connected to the second switching element.

20. The induction heating device of claim 19, wherein the plurality of snubber capacitors is configured to control and reduce inrush current or transient voltage generated by the first switching element and the second switching element.

* * * * *